US008453706B2

(12) United States Patent
Shepherd

(10) Patent No.: US 8,453,706 B2
(45) Date of Patent: Jun. 4, 2013

(54) LINK ASSEMBLY FOR AN AUTOMATIC DOOR OPENER EQUIPPED GARAGE DOOR

(76) Inventors: Jeffrey Scott Shepherd, Pretty Prairie, KS (US); Elizabeth Ann Shepherd, legal representative, Pretty Prairie, KS (US)

( * ) Notice: Subject to any disclaimer, the term of this patent is extended or adjusted under 35 U.S.C. 154(b) by 91 days.

(21) Appl. No.: 13/189,083

(22) Filed: Jul. 22, 2011

(65) Prior Publication Data

US 2012/0043030 A1 Feb. 23, 2012

Related U.S. Application Data

(60) Provisional application No. 61/402,035, filed on Aug. 23, 2010.

(51) Int. Cl.
*E05F 15/00* (2006.01)

(52) U.S. Cl.
USPC ..... 160/188; 160/201; 49/140; 49/199

(58) Field of Classification Search
USPC 160/188, 201; 49/139, 140, 199; 292/DIG. 2, 292/DIG. 36, 346; 16/412; 70/54–56; 248/551
See application file for complete search history.

(56) References Cited

U.S. PATENT DOCUMENTS 4,905,542 A * 3/1990 Burm et al. ..... 74/625
4,996,795 A * 3/1991 Niswonger ..... 49/280
5,010,688 A * 4/1991 Dombrowski et al. ..... 49/362
5,253,451 A * 10/1993 Hormann ..... 49/139
5,477,710 A * 12/1995 Stefanutti ..... 70/56
6,273,174 B1 * 8/2001 Singleton ..... 160/201
6,860,065 B2 * 3/2005 Griffin et al. ..... 49/139
7,878,032 B1 * 2/2011 Gogel ..... 70/56
8,220,296 B2 * 7/2012 Boonstra et al. ..... 70/2
2011/0316291 A1 * 12/2011 Loughlin et al. ..... 292/101
2012/0043030 A1 * 2/2012 Shepherd et al. ..... 160/188

OTHER PUBLICATIONS http://www.youtube.com/watch?v=RYwkNtGDTHk uploaded Apr. 6, 2011.*

Garage protect.com; "Garage Protect.com"; Internet web pages; Jul. 7, 2011; GarageProtect.com; U.S. publication.

* cited by examiner

*Primary Examiner* — Blair M. Johnson
(74) *Attorney, Agent, or Firm* — Kenneth H. Jack; Davis & Jack, L.L.C.

(57) ABSTRACT

An assembly for an automatic garage door including a slide bar, a motor, and a drive assembly connected to the slide bar, and a tie connected to the garage door; the assembly including a first "C" bracket having a lower web, the first "C" bracket receiving the slide bar and the motor and drive assembly being operatively connected to the first "C" bracket for longitudinally moving the first "C" bracket; a second "C" bracket having a lower web, the second "C" bracket nestingly receiving the first "C" bracket, and the tie being further connected to the second "C" bracket; a latching mechanism incorporated within the first and second "C" brackets' lower webs, the latching mechanism being adapted for resisting movements of the first and second "C" brackets away from each other; and a third "C" bracket having lower web, the third "C" bracket nestingly receiving the second "C" bracket.

8 Claims, 4 Drawing Sheets

LINK ASSEMBLY FOR AN AUTOMATIC DOOR OPENER EQUIPPED GARAGE DOOR

CLAIM OF PRIORITY FROM PREVIOUSLY FILED PROVISIONAL PATENT APPLICATION

This non-provisional patent application claims the benefit of and priority from U.S. provisional patent application No. 61/402,035 filed Aug. 23, 2010. The applicant asserts that structures and functions of structures disclosed and described in the instant application are the same as those described in said provisional application. The co-inventors disclosed in said provisional application are the same persons as the persons who are disclosed as the co-inventors in the instant application.

FIELD OF THE INVENTION

This invention relates to garage doors and automatic garage door openers. More particularly, this invention relates to apparatus and assemblies which are adapted for protecting automatic door opener equipped garage doors from unauthorized opening and entry.

BACKGROUND OF THE INVENTION

Common automatic garage door opening and closing assemblies incorporate first and second upwardly opening "C" brackets. In such assemblies, the second "C" bracket is commonly fitted for nestingly receiving the first "C" bracket, and the first "C" bracket is commonly fitted for nestingly and slidably receiving the garage door opener assembly's slide bar. In such common assemblies, the lower webs of the first and second "C" brackets which span between such brackets' arms are specially adapted to mechanically incorporate and include releasable locking means. In such locking means, the first "C" bracket's web typically presents a latch pawl receiving socket, and the second "C" bracket's web typically mechanically incorporates a lever actuated extendable and retractable latch pawl. Upon nesting receipt of the first "C" bracket within the second "C" bracket, the releasable locking means components of those brackets' webs operatively engage to securely hold those brackets in such nesting relation, allowing the first and second "C" brackets to provide a secure and releasable sliding linkage between the garage door opener's motor means and the garage door. Typically, a rigid and pivoting tie is provided, such tie spanning between and securely interconnecting the second "C" bracket and the garage door. The motor means typically directly mechanically engage the first "C" bracket for drawing the nestingly engaged "C" brackets forwardly and rearwardly along the slide bar, simultaneously raising and lowering the garage door.

A problem associated with garage door opener assemblies of the type described above is that burglars outside a closed garage door are often capable of gaining entry by actuating the release function of the assembly's releasable locking means, such access being achieved through the use of a stiff wire having a hooked end. Burglars are known to extend such wires over the upper edge of a closed garage door and into the interior of the garage to contact and hook against a release latch or lever which is typically incorporated within the garage door opener assembly's releasable locking means. Alternatively, such hook may engage a pull cord and handle which commonly hangs from the release lever. Upon outwardly pulling upon such stiff wire, the securely locked engagement between the assembly's first and second "C" brackets may be released, allowing the assembly's second "C" bracket, the attached rigid tie, and the garage door to freely slide upwardly and forwardly in relation to the first "C" bracket. Following such unauthorized hooking engagement, the burglar may simply manually raise the garage door and enter.

The instant inventive link assembly for an automatic door opener equipped garage door solves or ameliorates the problems discussed above by providing, instead of the pair of or first and second nesting "C" brackets described above, a triple or first, second, and third nesting "C" brackets, the web of the third "C" bracket being specially configured for shrouding and protecting the releasable locking means components which are mechanically incorporated into the webs of the first and second "C" brackets.

BRIEF SUMMARY OF THE INVENTION

The instant inventive link assembly is typically utilized as a component of an automatic door opener equipped garage door. Typically, such garage door is of the type which includes a series of pivoting rectangular segments whose lateral ends present rollers which travel within lateral roller tracks. The automatic door opener associated with such garage door typically comprises a slide bar which is commonly configured as an "I" beam whose rearward end is rigidly attached to the garage wall directly above the garage door, and whose forward end is rigidly supported at a motor case which typically is suspended from the garage's ceiling. Motor means associated with such slide bar component typically comprise a rearward idler sprocket or pulley and forward drive sprocket which are respectively rotatably mounted at rearward and forward ends of the slide bar. The motor means typically further comprise a drive chain and cable combination which extends about the idler pulley and drive sprocket. An electric motor housed within the case at the forward end of the slide bar typically rotatably drives the motor means' forward drive sprocket for driving the cable and drive chain combination along the slide bar forwardly and rearwardly in a continuous loop fashion. A rigid tie typically spans between the garage door and a link assembly, such assembly being fixedly attached to the cable component of the motor means' continuous loop drive and slidably engaging the slide bar. Such mechanically linked series of components conventionally allows the motor means to automatically raise and lower the garage door.

In combination with such common automatic garage door opener components, as described above, the instant inventive link assembly comprises a first "C" bracket having a lower web, the first "C" bracket nestingly receiving the slide bar for sliding forward and rearward motion. Where the slide bar is configured to present an "I" shaped cross-sectional profile, the lateral arms of the first "C" bracket preferably are configured to present laterally opposed "U" shaped channels which nestingly receive and capture the lateral edges of such "I" beam's lower flange. In the preferred embodiment, such first "C" bracket is mechanically linked to the cable component of the motor means' continuous loop chain drive and cable combination so that, as such combination travels about the forward drive sprocket and the rearward idler pulley or sprocket, the first "C" bracket simultaneously slidably moves forwardly and rearwardly along the slide bar.

A further component of the instant inventive link assembly comprises a second "C" bracket having, like the first "C" bracket, a lower web, the second "C" bracket nestingly receiving the first "C" bracket in the manner of the first "C" bracket's receipt of the slide bar. In the preferred embodiment of the instant invention, the rigid tie component preferably spans between the second "C" bracket and the garage door, such tie having pivoting linkages at both ends.

A further component of the instant inventive link assembly preferably comprises releasable locking means which comprise or are parts of the lower webs of the first and second "C" brackets. In the preferred embodiment, the lower web of the first "C" bracket presents a latch pawl receiving socket component of the releasable locking means. Correspondingly, the lower web of the second "C" bracket presents a lever actuated latch pawl extending and retracting mechanism, such mechanism constituting a further component of the releasable locking means. In the preferred embodiment, the releasable locking means are adapted for, upon the second "C" bracket's nesting receipt of the first "C" bracket, resisting sliding movements of the first and second "C" brackets away from each other. Accordingly, while the first and second "C" brackets are nestingly engaged with each other, their webs' locking components engage each other, requiring that they move along the slide bar in unison. Thus, upon such "C" bracket nesting engagement, raising and lowering motion of the garage door is advantageously directly controlled by operation of the motor means' electric motor. Alternatively, upon lever actuated disengagement of the releasable locking means, the first and second "C" brackets are freed for independent movements along the slide bar, allowing the garage door to be manually raised without operation of the assembly's motor means.

A further component of the instant inventive link assembly comprises a third "C" bracket which, like the first and second "C" brackets, has a lower web. In the preferred embodiment, the third "C" bracket nestingly receives the second "C" bracket in the same manner as the second and first "C" brackets' respective receipts of the first "C" bracket and the slide bar. Just as the webs of the first and second "C" brackets incorporate specially functioning structures, the web of the third "C" bracket preferably incorporates special structures which are adapted for shrouding and protecting the assembly's releasable locking means from unauthorized operation.

According to the function of the instant invention, in the event that the garage door is closed, and in the event that a burglar extends a wire hook over the upper edge of the garage door and into the interior of the garage, the shrouding and protecting function of the specialized web of the third "C" bracket advantageously resists any hooking engagement with the assembly's releasable locking means. Accordingly, the burglar's unauthorized attempts to open the garage door are advantageously frustrated.

The third "C" bracket is preferably composed of durable flexible plastic, allowing the third "C" bracket to be easily laterally splayed for installation over the second "C" bracket, and allowing the third "C" bracket's elastic return to its normal configuration to function as a secure means for bracket attachment.

Accordingly, it is an object of the instant invention to provide a link assembly for an automatic door opener equipped garage door which incorporates components and structures as described above, and which arranges those components and structures in manners as described above, for the performance of advantageous functions, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
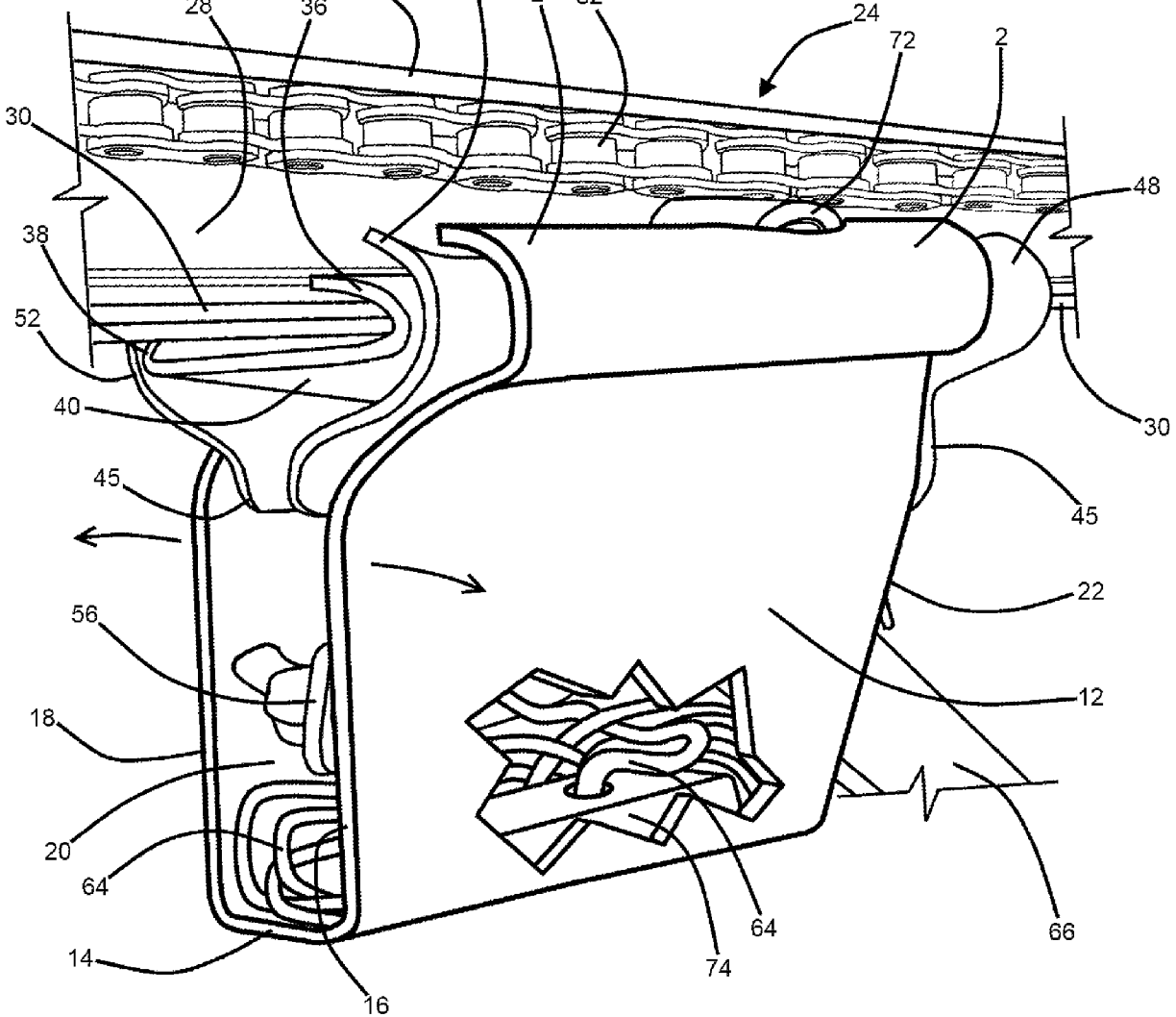
FIG. 1 is a perspective view of the instant inventive link assembly for an automatic door opener equipped garage door.

The garage door component of the instant inventive assembly is conventional, typically comprising a pivotably linked series of rectangular door panels, each of which presents rollers at its lateral ends. Such door panels and rollers typically travel along lateral roller tracks which guide the garage door from its vertical closed position to a horizontal and overlying opened position. Referring to FIG. 1, a slide bar, referred to generally by Reference Arrow 24, is conventionally installed in relation to such garage door. The slide bar 24 commonly has an "I" shaped cross-sectional configuration which presents an upper flange 26, a lower flange 30, and has a web 28 which spans vertically between the upper and lower flanges 26 and 30. In a typical embodiment, the rearward end of the slide bar 24 is rigidly attached to a garage wall directly above the garage door, and the forward end of the slide bar 24 is rigidly supported at a motor casing which is typically suspended by ties from the garage's ceiling.

Referring further to FIG. 1, a drive chain 32 is representative of typical and conventional automatic garage door opener motor means which are associated with the slide bar 24. Such motor means typically further incorporate a front drive sprocket, a rear idler pulley or sprocket, a steel cable, and an electric motor (each not being within the views of the drawings). The chain drive 32 and cable components of the motor means typically wrap around the front and rear sprockets or pulleys which are typically rotatably mounted at front and rear ends of the slide bar 24, and the motor means' electric motor is typically housed within the assembly's forward casing for rotatably driving the forward sprocket. A continuous drive loop is typically completed by the steel cable which extends along the opposite side of web 28 and which interconnects ends of the chain drive 32.

Figure 3:
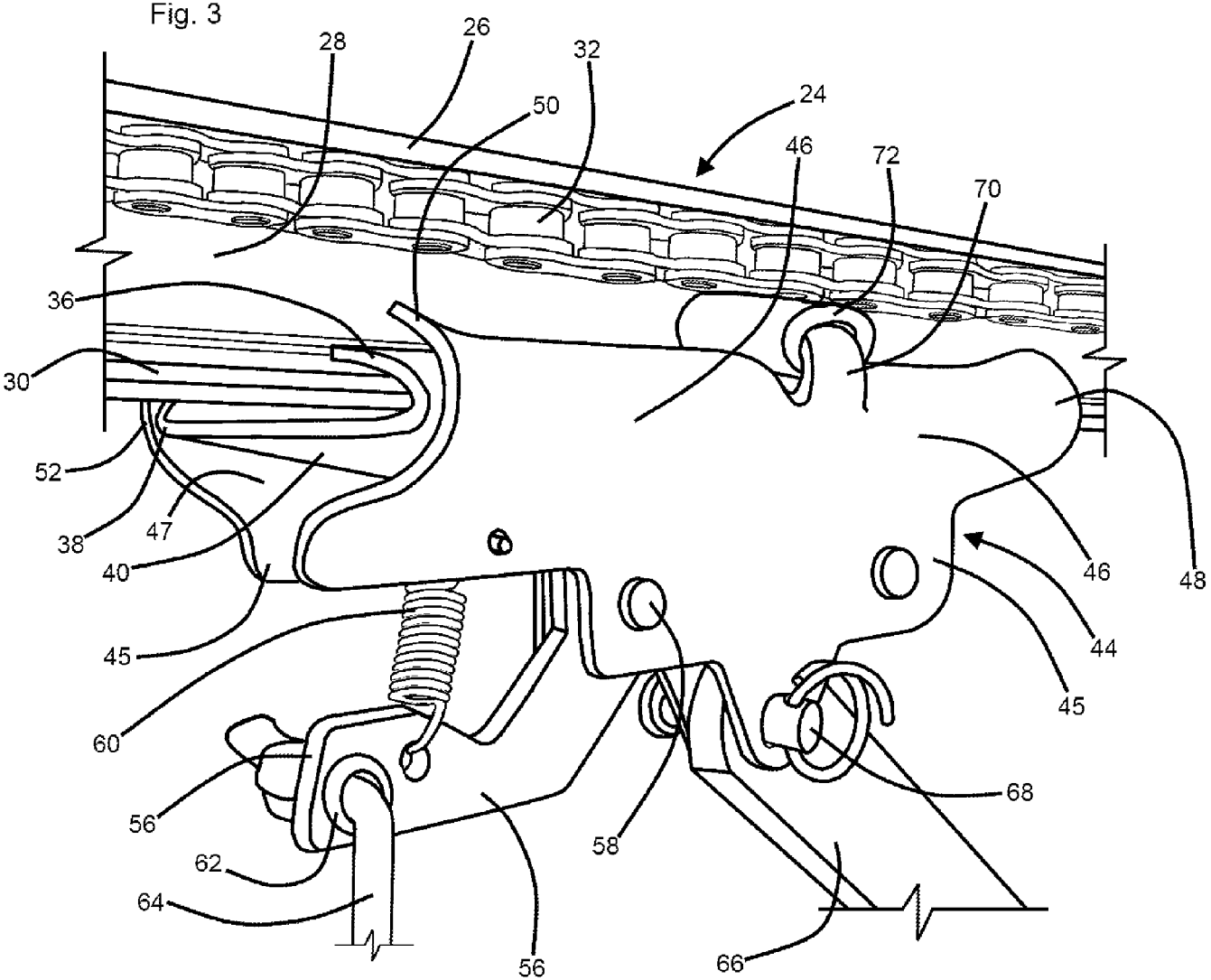
FIG. 3 redepicts FIG. 1, the view of FIG. 3 showing the third "C" bracket component removed.
Figure 4:
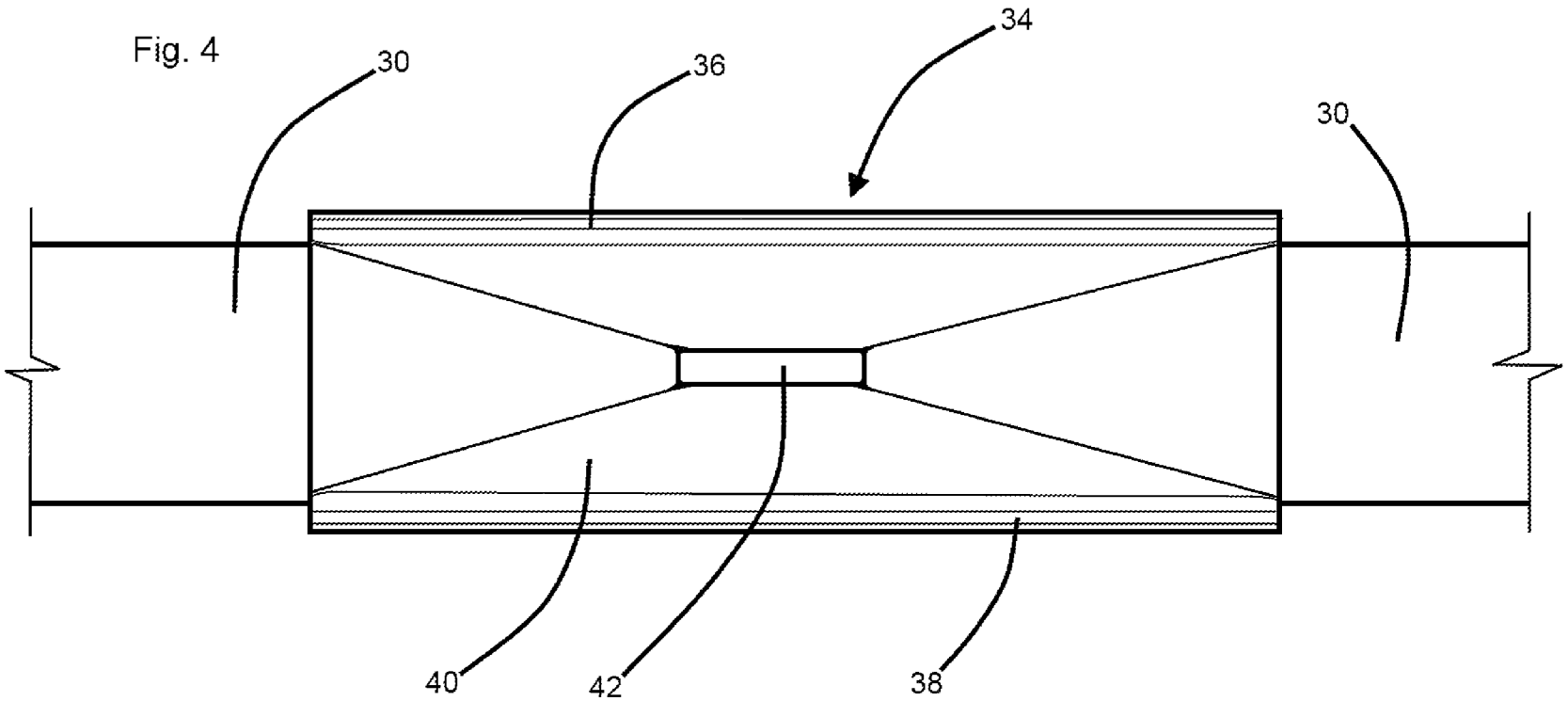
FIG. 4 is a lower plan view of a first "C" bracket component of the instant inventive assembly.

Referring simultaneously to FIGS. 3 and 4, a first "C" bracket is referred to generally by Reference Arrow 34, the first "C" bracket 34 preferably comprising a lower web 40, and comprising left and right "U" channel forming arms 36 and 38. Such arms 36 and 38 slidably capture the left and right edges of the lower flange 30 of the slide bar 24. The distal end of arm 38 of the first "C" bracket 34 preferably presents a mechanical link (not depicted within views) which securely attaches to the cable portion of the motor means' continuous drive loop.

Referring further to FIGS. 3 and 4, a second "C" bracket is referred to generally by Reference Arrow 44, the second "C" bracket, like the first "C" bracket 34, having left and right "U" channel forming arms 46 and 47, and having a lower web portion 45 which spans between and laterally interconnects proximal ends of such arms 46 and 47. A rigid tie 66 is preferably fixedly and pivotally attached to the second "C" bracket's lower web 45 by means of a pin and aligned eyes joint 68. Preferably, the forward and rearward ends of the left and right arms 46 and 47 of the second "C" bracket 44 include flared portions 52, 50, and 48 which allow the second "C" bracket 44 to easily slide over and nestingly receive the first "C" bracket 34.

Referring further simultaneously to FIGS. 3 and 4, the lower webs 40 and 45 of the first and second "C" brackets 34 and 44 are preferably specially configured to present releasable locking means. Such means preferably comprise a latch pawl receiving socket 42 which opens within the web 40 of the first "C" bracket 44, and a releasable latch assembly 56, 58, 60 which is incorporated within the web 45 of the second "C" bracket 44. In operation of the releasable locking means, a lever arm 56 may pivot about pivot pin 58, such lever arm 56 and pivot pin 58 controlling upwardly extending and downwardly retracting motions of a latch pawl (not depicted within views), such pawl being engageable with latch pawl receiving socket 42. Spring 60 normally biases the lever arm 56 and its mechanically associated latch pawl for, upon sliding and nesting engagement of the second "C" bracket 44 with the first "C" bracket 34 as depicted in FIG. 3, capturing such latch pawl within latch pawl receiving socket 42. Typically, a pull cord 64 is tied to lever arm 56 at eye 62, and a buffer sleeve 72 is mounted upon an arm 70 which extends upwardly from the distal end of arm 46, such sleeve preventing any impinging contact between the drive chain 32 and the flared ends 52,50, 48 of the second "C" bracket's left and right arms 46 and 47.

Figure 2:
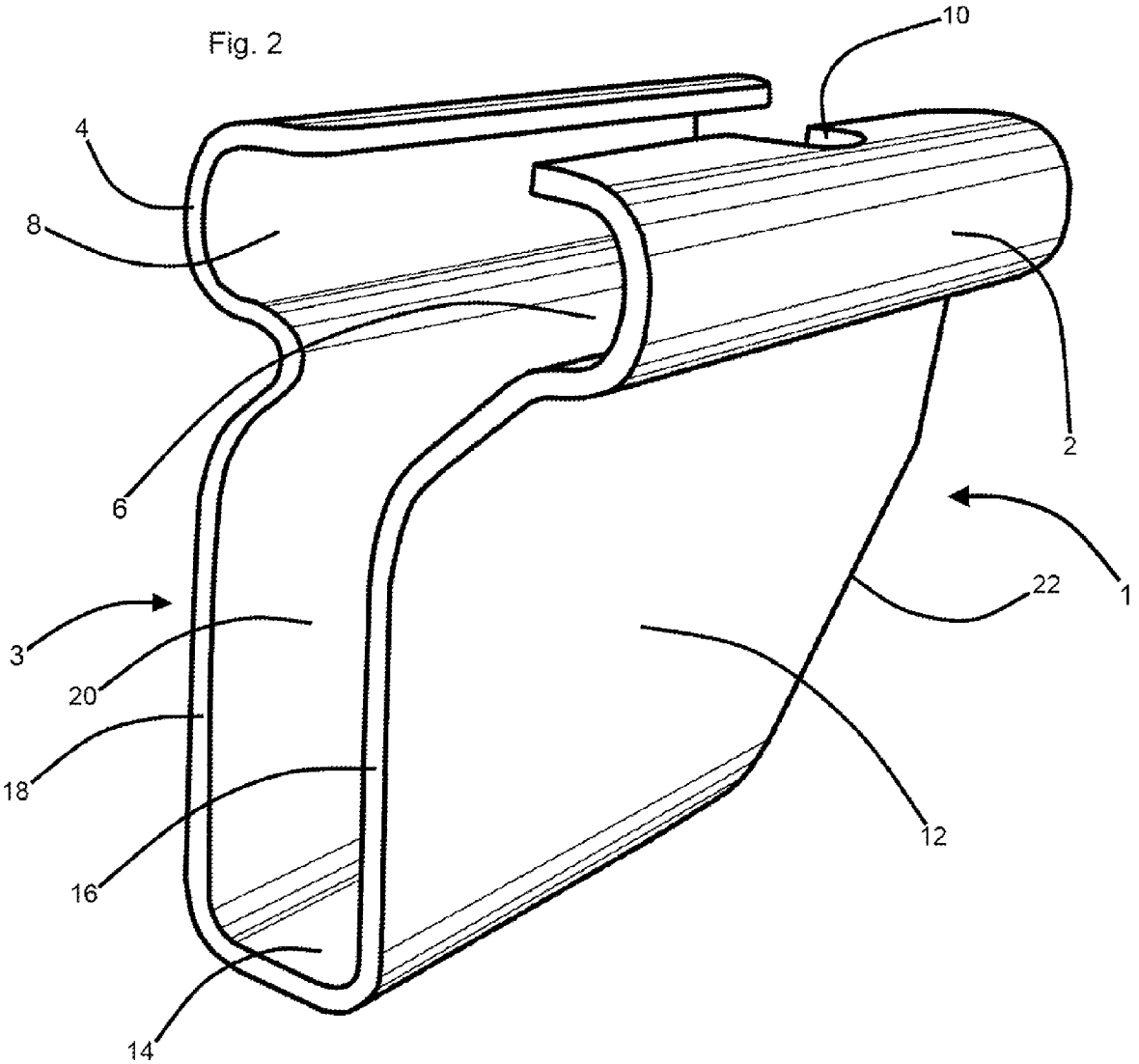
FIG. 2 presents a perspective view of a third "C" bracket component of the instant inventive assembly.

Referring to FIGS. 1-3, a third "C" bracket component of the instant inventive assembly is referred to generally by Reference Arrow 1. The third "C" bracket 1 preferably has left and right arms 2 and 4 which, like the arms 36, 38, 46, and 47 of "C" brackets 34 and 44, form left and right "U" channels 6 and 8. To facilitate installation of the third "C" bracket 1, the distal end of arm 2 preferably presents a chain drive buffer clearance slot 10.

The third "C" bracket 1 has a web which is referred to generally by Reference Arrow 3, the web 3 spanning between and laterally interconnecting proximal ends of arms 2 and 4. Referring simultaneously to FIGS. 1 and 3, the web 3 is preferably specially configured to present forward edges 16 and 18 which, upon engagement of the first "C" bracket 1 with the second "C" bracket 2, advantageously co-extend along and shroud the lever arm 56 component of the releasable locking means. The web 3 of the third "C" bracket 1 preferably includes a downward extension 12 which presents a floor 14 and defines a storage space 20, the rearward end of such downward extension 12 preferably including a chamfer or bevel 22 for facilitating pivoting movements of the rigid tie 66.

Referring simultaneously to all figures, the third "C" bracket 1 is preferably composed of durable and flexible plastic in order to allow the left and right arms 2 and 4 to be temporarily splayed laterally away from each other in the direction of the arrows drawn upon FIG. 1, such arrows signifying movement of the first "C" bracket's arms toward a bracket releasing and removal position. Upon such lateral splaying, such arms 2 and 4 may be placed over the left and right arms 46 and 47 of the second "C" bracket 44, and such arms 2 and 4 may be allowed to elastically and flexibly return to their normal use position, conveniently installing the bracket as depicted. In their installed positions, the "U" channels 6 and 8 of arms 2 and 4 nestingly capture the lateral outer surfaces of the left and right arms 46 and 47 of the second "C" bracket 44.

In the preferred embodiment, the front to rear or longitudinal length of the arms 2 and 4 of the third "C" bracket are fitted to nest between the front and rear flares 50, 52, 48 of the second "C" bracket. Accordingly, such flares 52, 50, and 48 advantageously dually function for facilitating sliding engagement of the second "C" bracket 44 over the first "C" bracket 34, and for retention of the third "C" bracket 1 in its latch shrouding use position.

Referring further simultaneously to all figures, the floor 14 of the third "C" bracket 1 preferably resides at a position below the lever arm 56 component of the releasable locking means, such positioning allowing a portion of the storage space 20 to underlie such lever. Pull cord 64, along with a pull handle 74 attached to the lower end of such pull cord 64, may be advantageously stored within such space 20, and may be there protected from unauthorized access and use.

Referring to FIG. 3, it may be seen that a burglary tool such as a stiff length of wire with a hook at its end (not depicted within views) may be extended forwardly over the closed garage door to engage lever arm 56 or pull cord 64. Upon rearward pulling of such burglary tool against lever arm 56 or against pull cord 64, the burglar may undesirably disengage the releasable locking means, allowing the second "C" bracket 44 to independently slidably move forwardly from the first "C" bracket 34 and along the slide bar 30. Upon such release, the burglar may freely manually raise the garage door.

Upon installation of the third "C" bracket 1 in the use configuration depicted in FIG. 1, the co-extending forward edge components 16 and 18 of the web 3 of that bracket advantageously shroud the lever arm 56. The web's storage space 20 of web 3 may also advantageously receive, house, and shroud the pull cord 64 and the pull handle 74. The shrouding and housing functions which are performed by the third "C" bracket 1 advantageously resist any engagements of burglary tools with lever arm 56 or with the pull cord 64. Accordingly, the instant invention advantageously prevents unauthorized disengagement of the releasable locking means and prevents burglars' unauthorized entries into the garage.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A link assembly for an automatic door opener equipped garage door, the automatic door opener comprising a slide bar, motor means connected operatively to the slide bar, and a rigid tie connected operatively to the garage door, the link assembly comprising:

(a) a first "C" bracket having a lower web, the first "C" bracket nestingly receiving the slide bar, the motor means being further operatively connected to the first "C" bracket for moving the first "C" bracket along the slide bar;

(b) a second "C" bracket having a lower web, the second "C" bracket being adapted for nestingly receiving the first "C" bracket, the rigid tie being further operatively connected to the second "C" bracket;

(c) releasable locking means comprising the first and second "C" brackets' lower webs, the releasable locking means being adapted for, upon the second "C" bracket's nesting receipt of the first "C" bracket, resisting movements of the first and second "C" brackets away from each other; and (d) a third "C" bracket having lower web, the third "C" bracket nestingly receiving the second "C" bracket.

2. The link assembly of claim 1 wherein the third "C" bracket's web is adapted for shrouding the locking means.

3. The link assembly of claim 2 wherein the third "C" bracket's web has a forward edge; wherein the releasable locking means further comprise a forwardly extending lever arm; and wherein the adaptation for shrouding the locking means co-extends the third "C" bracket's forward edge with the forwardly extending lever arm.

4. The link assembly of claim 3 wherein the third "C" bracket's web has a floor; wherein the releasable locking means further comprise a pull cord connected operatively to the lever arm; and wherein the adaptation for shrouding the locking means downwardly extends the web's floor, said downward extension defining a pull cord storage space.

5. The link assembly of claim 4 further comprising a pull handle fixedly attached to the pull cord, the pull cord storage space being fitted for receiving the pull cord and the pull handle.

6. The link assembly of claim 5 wherein the second "C" bracket has flared forward and rearward ends, and wherein the third "C" bracket is fitted for, upon the third "C" bracket's nesting receipt of the second "C" bracket, retention of the third "C" bracket by the second "C" bracket's flared forward and rearward ends.

7. The link assembly of claim 6 wherein the third "C" bracket is adapted for laterally flexing between second "C" bracket retaining and releasing positions.

8. The link assembly of claim 7 wherein the third "C" bracket comprises flexible plastic.

* * * * *